US008900059B2

(12) United States Patent
Hutchison-Kay

(10) Patent No.: US 8,900,059 B2
(45) **Date of Patent: *Dec. 2, 2014**

(54) GAMING NETWORK

(75) Inventor: Christer Hutchison-Kay, Taby (SE)

(73) Assignee: ACEI AB, Stockholm (SE)

( * ) Notice: Subject to any disclaimer, the term of this patent is extended or adjusted under 35 U.S.C. 154(b) by 223 days.

This patent is subject to a terminal disclaimer.

(21) Appl. No.: 13/408,745

(22) Filed: Feb. 29, 2012

(65) Prior Publication Data

US 2012/0157214 A1 Jun. 21, 2012

Related U.S. Application Data

(63) Continuation of application No. 12/237,051, filed on Sep. 24, 2008, now Pat. No. 8,147,338.

(30) Foreign Application Priority Data

Sep. 25, 2007 (AU) ..... 2007905240

(51) Int. Cl.
*G07F 17/32* (2006.01)

(52) U.S. Cl.
USPC ..... 463/42

(58) Field of Classification Search
USPC ..... 463/42
See application file for complete search history.

(56) References Cited

U.S. PATENT DOCUMENTS

| | | | |
|---|---|---|---|
| 4,856,787 | A | 8/1989 | Itkis |
| 6,921,337 | B1 | 7/2005 | Kennedy et al. |
| 8,147,338 | B2 | 4/2012 | Hutchison-Kay |
| 2001/0035088 | A1 | 11/2001 | Faecher |
| 2004/0204244 | A1 | 10/2004 | Rathsack et al. |
| 2009/0191972 | A1 | 7/2009 | Hutchison-Kay |

FOREIGN PATENT DOCUMENTS

| | | |
|---|---|---|
| GB | 2148135 | 5/1985 |
| RU | 2202124 | 4/2003 |

OTHER PUBLICATIONS

United States Patent and Trademark Office, "Notice of Allowance," issued in connection with U.S. Appl. No. 12/237,051, mailed on Dec. 1, 2011, 10 pages.

United States Patent and Trademark Office, "Non-Final Office Action," issued in connection with U.S. Appl. No. 12/237,051, mailed on Apr. 20, 2011, 11 pages.

*Primary Examiner* — Omkar Deodhar
(74) *Attorney, Agent, or Firm* — Hanley, Flight and Zimmerman, LLC

(57) ABSTRACT

A gaming network is disclosed which includes point to point cabling infrastructure connectable to at least one first gaming machine and connectable to at least one second gaming machine. Each first gaming machine is arranged to communicate using a master/slave protocol, and each second gaming machine is arranged to communicate using a point to point protocol. The gaming network also includes an interface device having a communications bus connectable to a master/slave control device and to the point to point cabling infrastructure such that each first gaming machine is connected to the communications bus and is controllable by the master/slave control device through the point to point cabling infrastructure. The point to point cabling infrastructure is also connectable to a point to point control device such that at least one second gaming machine is controllable by the point to point control device through the point to point cabling infrastructure.

20 Claims, 2 Drawing Sheets

GAMING NETWORK

CROSS-REFERENCE TO RELATED APPLICATIONS

This patent arises from and claims priority to as a continuation of U.S. patent application Ser. No. 12/237,051, filed Sep. 24, 2008, entitled "A GAMING NETWORK," which claims the benefit of priority to Australian Provisional Patent Application No. 2007905240, filed on Sep. 25, 2007, entitled "A GAMING NETWORK", both of which are herein incorporated by reference in its entireties.

FIELD OF THE INVENTION

The present invention relates to a gaming network of the type including a plurality of gaming machines in networked communication with one or more gaming control and/or administration devices.

BACKGROUND OF THE INVENTION

It is known to provide a gaming network of the type wherein multiple gaming machines are connected together in a master/slave type arrangement. In one implementation, a bus is connected to a master/slave control device and each gaming machine is connected to the bus. Communications between the master/slave control device and the gaming machines are controlled by the master/slave control device and are based on conventional master/slave type protocols. This type of gaming network is generally implemented in accordance with RS485 standards.

More recently, it is becoming increasingly common to replace such RS485 master/slave type gaming networks with point to point Ethernet type gaming networks wherein multiple gaming machines are connected in a point to point type arrangement with a network switch and through the network switch to a gaming control device.

However, in order for a business to transition from a master/slave RS485 type network arrangement to a point to point Ethernet type network arrangement significant expense will be incurred including costs in replacing master/slave based gaming machines with point to point Ethernet based gaming machines.

SUMMARY OF THE INVENTION

In accordance with a first aspect of the present invention, there is provided a gaming network including:

point to point cabling infrastructure connectable to at least one first gaming machine and connectable to at least one second gaming machine, each first gaming machine arranged to communicate using a master/slave protocol, and each second gaming machine arranged to communicate using a point to point protocol;

an interface device having a communications bus connectable to a master/slave control device and to the point to point cabling infrastructure such that each first gaming machine is connected to the communications bus and is controllable by the master/slave control device through the point to point cabling infrastructure;

the point to point cabling infrastructure being connectable to a point to point control device such that the at least one second gaming machine is controllable by the point to point control device through the point to point cabling infrastructure.

In one embodiment, the gaming network includes a master/slave control device arranged to control the first gaming machines.

In one embodiment, the gaming network includes a point to point control device arranged to control the second gaming machines.

In one embodiment, the point to point cabling infrastructure includes a plurality of twisted pair cables. Each twisted pair cable may be a Cat 5 type cable. Each twisted pair cable may include a RJ45 type connector.

In one embodiment, each first gaming machine is arranged so as to communicate through the point to point cabling infrastructure using a master/slave protocol in accordance with a RS485 standard.

In one embodiment, each second gaming machine is arranged so as to communicate through the point to point cabling infrastructure using a point to point protocol in accordance with an Ethernet standard.

In one embodiment, the gaming network further includes a patch panel having a plurality of patch sockets, each first and second gaming machine being connected to a patch socket through the point to point cabling infrastructure, and a plurality of patch cables arranged to facilitate selective connection between the patch sockets and the master/slave control device or point to point control device.

In one embodiment, the gaming network further includes a network switch disposed between the point to point control device and the point to point cabling infrastructure.

BRIEF DESCRIPTION OF THE DRAWINGS

Certain embodiments of the present invention will now be described, by way of example only, with reference to the accompanying drawings, in which.

Figure 1:
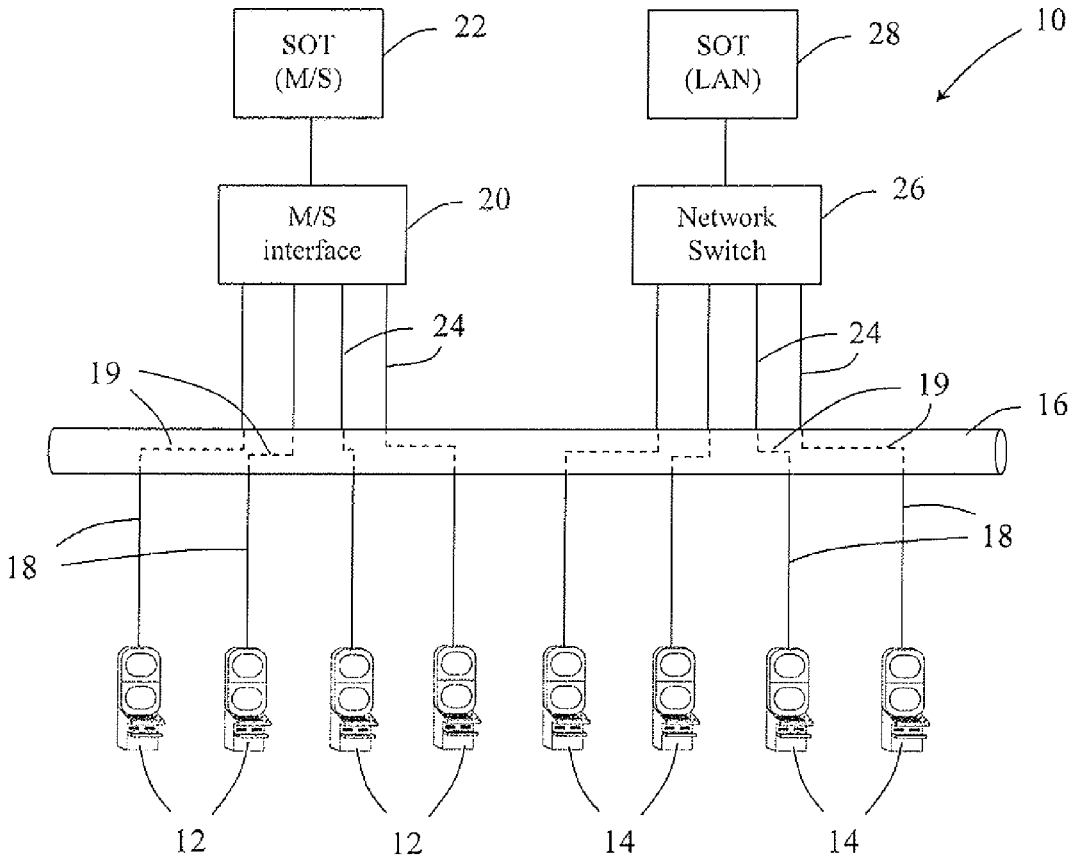
FIG. 1 is a schematic diagram of a gaming network in accordance with an embodiment of the present invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DESCRIPTION OF CERTAIN EMBODIMENTS

Referring to FIG. 1 of the drawings, there is shown a gaming network 10 which is capable of connecting to gaming machines 12, 14 of the type using a master/slave type protocol and to gaming machines using point to point type protocols through a common point to point cabling infrastructure 16.

The gaming network 10 is connectable to at least one first gaming machine 12 arranged to communicate using a master/slave type protocol, and to at least one second gaming machine 14 arranged to communicate using a point to point type protocol. In this example, each of the first and second gaming machines 12, 14 connects to the point to point cabling infrastructure 16 using first twisted pair cables 18 terminated with RJ45 type connectors. A suitable twisted pair cable is a CAT-5 cable commonly used in conventional Ethernet networks.

In this example, the point to point cabling infrastructure 16 includes a plurality of second twisted pair cables 19, each second twisted pair cable 19 being terminated at a RJ45 type socket.

The first gaming machines 12 are connected through respective second twisted pair cables 19 in the point to point cabling infrastructure 16 and through respective third twisted pair cables 24 to a master/slave interface device 20, and through the master/slave interface device 20 to a master/slave control device 22. As with the first cables 18, in this example the third twisted pair cables 24 are terminated with RJ45 type connectors.

The master/slave control device 22 is arranged to handle administration of the first gaming machines 12, to control the status and properties of the first gaming machines 12, and to monitor information associated with the first gaming machines 12 such as the bandwidth, and CPU and memory usage associated with the first gaming machines 12. The master/slave control device 22 may be referred to as a site operator terminal (SOT).

The second gaming machines 14 are connected through respective second twisted pair cables 19 in the point to point cabling infrastructure 16 and through respective third twisted pair cables 24 to a network switch 26, and through the network switch 26 to a LAN control device 28. The third twisted pair cables 24 are in this example terminated with RJ45 type connectors.

The LAN control device 28 is arranged to handle administration of the second gaming machines 14, to control the status and properties of the second gaming machines 14, and to monitor information associated with the second gaming machines 14 such as the bandwidth, and CPU and memory usage associated with the second gaming machines 14. The LAN control device 22 may also be referred to as a site operator terminal (SOT).

Figure 2:
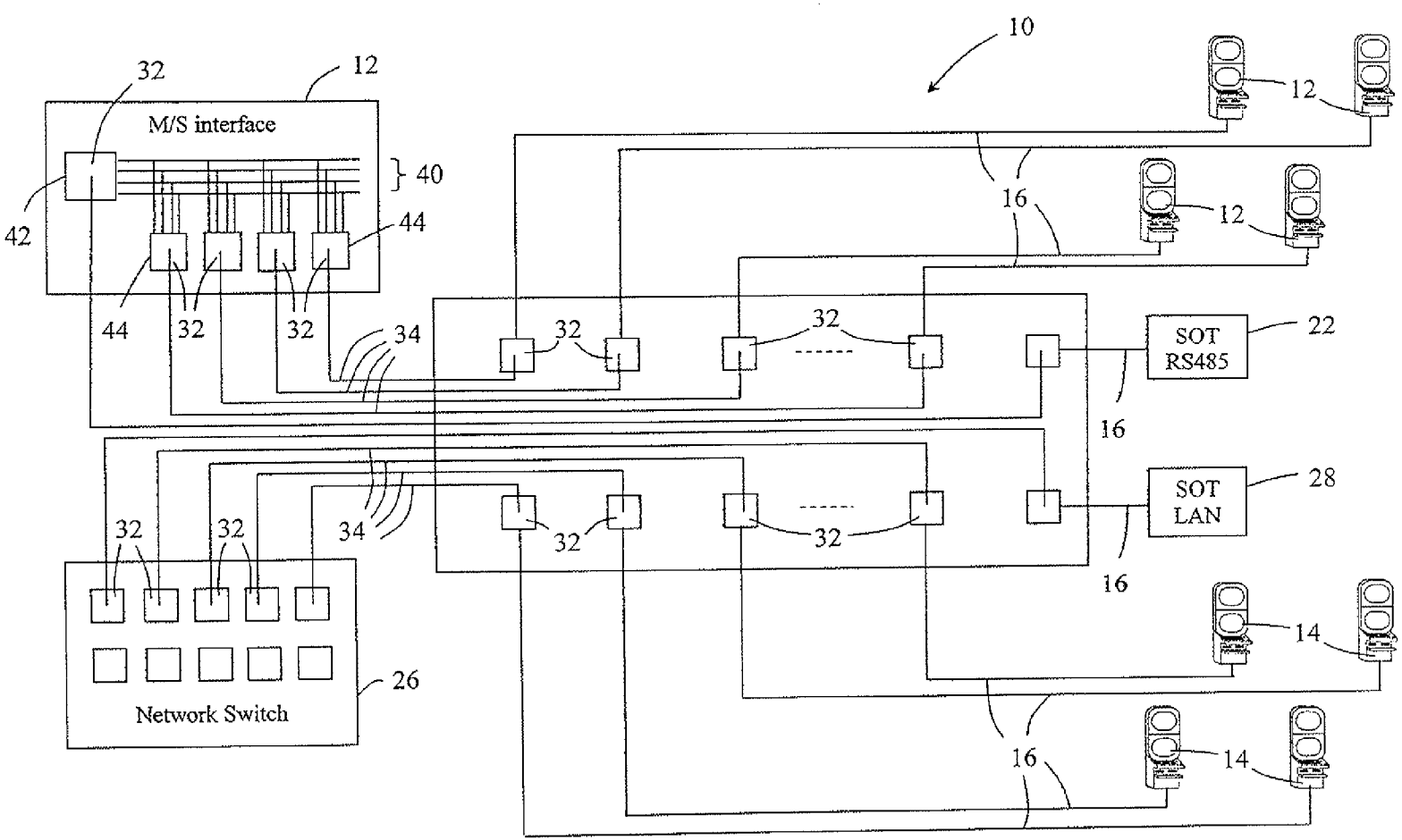
FIG. 2 is a schematic diagram of the gaming network shown in FIG. 1 with the gaming network incorporating a patch panel.

As shown more particularly in FIG. 2, a patch panel 30 may be incorporated into the gaming network 10 between the point to point cabling infrastructure 16 and the master/slave and LAN control devices 22, 28 so that by appropriate connection of RJ45 connectors 32 of patch cables 34 between the patch panel 30 and the master/slave and LAN control devices 22, 28, a gaming machine 12, 14 may be connected through the point to point cabling infrastructure 16 to either the master/slave interface device 20 or the network switch 26.

As shown more particularly in FIG. 2, the master/slave interface device 20 includes a communications bus 40 connected to a master socket 42, in this example of RJ45 type and a plurality of slave sockets 44, in this example of RJ45 type also connected to the communications bus 40.

It will be appreciated that by connecting the master/slave control device 22 to the master socket 42 through the point to point infrastructure 16 and connecting each first gaming machine 12 through the point to point infrastructure 16 to a slave socket 44, it is possible for the master/slave control device 22 to communicate with the first gaming machines 12 through the point to point infrastructure 16 using a suitable master/slave protocol.

It will also be appreciated that by connecting the LAN control device 28 to the network switch 26 through the point to point infrastructure 16 and connecting each second gaming machine 14 through the point to point infrastructure 16 to the network switch, it is possible for the LAN control device 28 to communicate with the second gaming machines 14 through the point to point infrastructure 16 using a suitable point to point protocol.

It will be understood, therefore, that with certain embodiments of the present invention it is possible to incorporate gaming machines of master/slave protocol type and point to point protocol type into the same gaming network and to use a single point to point cabling infrastructure to communicate with the gaming machines. As a consequence, it is possible for a gaming operator to install a point to point cabling infrastructure so as to implement a point to point Ethernet type gaming network whilst maintaining the ability to communicate with legacy gaming machines of master/slave protocol type.

It will also be understood that should any of the legacy master/slave protocol type gaming machines 12 be replaced with a point to point protocol type gaming machines 14, the respective connection to the master/slave interface device 20 need only be connected instead to the network switch 26. This is easily facilitated in the example shown in FIG. 2 by appropriate connection of the relevant patch cables 34.

In the claims of this application and in the description of the invention, except where the context indicates otherwise due to express language or necessary implication, the words "comprise" or variations such as "comprises" or "comprising" are used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

Modifications and variations as would be apparent to a skilled addressee are deemed to be within the scope of the present invention.

Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

Method steps associated with certain embodiments may be implemented in one embodiment by a program product including machine-executable instructions, such as program code, for example in the form of program modules executed by machines in networked environments. Generally, program modules include routines, programs, objects, components, data structures, etc., that perform particular tasks or implement particular abstract data types. Machine-executable instructions, associated data structures, and program modules represent examples of program code for executing steps of the methods disclosed herein. The particular sequence of such executable instructions or associated data structures represents examples of corresponding acts for implementing the functions described in such steps.

The invention claimed is:

1. A gaming network comprising:

point to point cabling infrastructure connectable to at least one first gaming machine and connectable to at least one second gaming machine, each first gaming machine arranged to communicate using a master/slave protocol, and each second gaming machine arranged to communicate using a point to point protocol;

a master/slave control device arranged to control the at least one first gaming machine;

an interface device connectable to the master/slave control device and to the point to point cabling infrastructure such that each first gaming machine is controllable by the master/slave control device through the point to point cabling infrastructure; and a point to point control device arranged to control the at least one second gaming machine, the point to point cabling infrastructure connectable to the point to point control device such that the at least one second gaming machine is controllable by the point to point control device through the point to point cabling infrastructure.

2. A gaming network as claimed in claim 1, wherein the point to point cabling infrastructure comprises a plurality of twisted pair cables.

3. A gaming network as claimed in claim 2, wherein at least one twisted pair cable is a Cat 5 type cable.

4. A gaming network as claimed in claim 2, wherein at least one twisted pair cable comprises a RJ45 type connector.

5. A gaming network as claimed in claim 1, wherein each first gaming machine is arranged so as to communicate through the point to point cabling infrastructure using a master/slave protocol in accordance with a RS485 standard.

6. A gaming network as claimed in claim 1, wherein each second gaming machine is arranged so as to communicate through the point to point cabling infrastructure using a point to point protocol in accordance with an Ethernet standard.

7. A gaming network as claimed in claim 1, comprising a patch panel having a plurality of patch sockets, each first and second gaming machine being connected to a patch socket through the point to point cabling infrastructure, and a plurality of patch cables arranged to facilitate selective connection between the patch sockets and the master/slave control device or point to point control device.

8. A gaming network as claimed in claim 1, comprising a network switch disposed between the point to point control device and the point to point cabling infrastructure.

9. A gaming network as claimed in claim 1, wherein the master/slave control device is arranged to monitor information associated with the at least one first gaming machine.

10. A gaming network as claimed in claim 9, wherein the information includes at least one of bandwidth, processor usage, and memory usage associated with the at least one first gaming machine.

11. A gaming network as claimed in claim 1, wherein the master/slave control device is arranged to control a status and at least one property of the at least one first gaming machine.

12. A gaming network as claimed in claim 1, wherein the point to point control device comprises a local area network control device.

13. A gaming network as claimed in claim 1, wherein the point to point control device is arranged to monitor information associated with the at least one second gaming machine.

14. A gaming network as claimed in claim 13, wherein the information includes at least one of bandwidth, processor usage, and memory usage associated with the at least one first gaming machine.

15. A gaming network as claimed in claim 1, wherein the point to point control device is arranged to control a status and at least one property of the at least one first gaming machine.

16. A gaming network infrastructure device comprising:

a point to point cabling infrastructure connectable to at least one first gaming machine and connectable to at least one second gaming machine, each first gaming machine arranged to communicate using a master/slave protocol, and each second gaming machine arranged to communicate using a point to point protocol; and an interface device connectable to a master/slave control device and to the point to point cabling infrastructure such that each first gaming machine is controllable by the master/slave control device through the point to point cabling infrastructure;

the point to point cabling infrastructure connectable to a point to point control device such that the at least one second gaming machine is controllable by the point to point control device through the point to point cabling infrastructure.

17. A gaming network infrastructure device as claimed in claim 16, wherein the master/slave control device is arranged to monitor information associated with the at least one first gaming machine.

18. A gaming network infrastructure device as claimed in claim 16, wherein the master/slave control device is arranged to control a status and at least one property of the at least one first gaming machine.

19. A gaming network infrastructure device as claimed in claim 16, wherein the point to point control device is arranged to monitor information associated with the at least one second gaming machine.

20. A gaming network infrastructure device as claimed in claim 16, wherein the point to point control device is arranged to control a status and at least one property of the at least one first gaming machine.

* * * * *